US007306048B2

(12) United States Patent
Yamazaki

(10) Patent No.: US 7,306,048 B2
(45) Date of Patent: Dec. 11, 2007

(54) HAMMER DRILL HAVING SWITCHING MECHANISM FOR SWITCHING OPERATION MODES

(75) Inventor: Shingo Yamazaki, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 83 days.

(21) Appl. No.: 11/284,962

(22) Filed: Nov. 23, 2005

(65) Prior Publication Data

US 2006/0108132 A1 May 25, 2006

(30) Foreign Application Priority Data

Nov. 24, 2004 (JP) ..... P2004-338864
Apr. 13, 2005 (JP) ..... P2005-115734

(51) Int. Cl.
*B25D 11/04* (2006.01)

(52) U.S. Cl. ..... 173/48; 173/212

(58) Field of Classification Search ..... 173/48, 173/104, 93, 93.5, 216, 205, 109, 112, 178, 173/91

See application file for complete search history.

(56) References Cited

U.S. PATENT DOCUMENTS

| | | | | |
|---|---|---|---|---|
| 5,111,890 | A * | 5/1992 | Ranger et al. | 173/104 |
| 5,975,217 | A | 11/1999 | Frenzel | |
| 6,035,945 | A | 3/2000 | Ichijyou et al. | |
| 6,116,352 | A | 9/2000 | Frauhammer | |
| 6,176,321 | B1 * | 1/2001 | Arakawa et al. | 173/48 |
| 6,192,996 | B1 | 2/2001 | Sakaguchi et al. | |
| 6,557,648 | B2 | 5/2003 | Ichijyou et al. | |
| 6,609,577 | B2 * | 8/2003 | Beccu | 173/93.6 |
| 6,675,908 | B1 * | 1/2004 | Frauhammer et al. | 173/48 |
| 6,691,796 | B1 * | 2/2004 | Wu | 173/48 |
| 6,712,156 | B2 * | 3/2004 | Funfer | 173/48 |
| 6,913,090 | B2 * | 7/2005 | Droste et al. | 173/109 |
| 6,938,705 | B2 * | 9/2005 | Kikuchi | 173/201 |
| 2003/0094292 | A1 | 5/2003 | Haga | |
| 2004/0211574 | A1 | 10/2004 | Droste et al. | |

FOREIGN PATENT DOCUMENTS

| | | |
|---|---|---|
| DE | 33 28 886 | 2/1984 |
| DE | 33 16 013 | 11/1984 |
| DE | 39 32 134 | 4/1991 |
| EP | 0 429 475 | 6/1991 |
| WO | WO 90/01400 | 2/1990 |

* cited by examiner

*Primary Examiner*—Brian D. Nash
(74) *Attorney, Agent, or Firm*—Antonelli, Terry, Stout & Kraus, LLP.

(57) ABSTRACT

An air chamber is formed in a cylinder between a piston and a striking member. The cylinder is formed with at least one through-hole for providing fluid communication between the air chamber and an outside of the cylinder. A switching mechanism switches operation modes between a first operation mode and a second operation mode. In the first operation mode, the at least one through-hole is closed when the working tool is moved toward the another end and, when the at least one through-hole is closed, reciprocating motion of the piston generates pressure changes in the air chamber, allowing the striking member to transmit a striking force to a working tool. In the second operation mode, the at least one through-hole is constantly open, prohibiting the striking member from transmitting a striking force to the working tool.

20 Claims, 9 Drawing Sheets

HAMMER DRILL HAVING SWITCHING MECHANISM FOR SWITCHING OPERATION MODES

BACKGROUND OF THE INVENTION

1. Field of the Invention

The present invention relates to a hammer drill functioning both as a hammer and as a drill and including a striking force transmitting mechanism for applying a striking force to a working tool, and a rotational force transmitting mechanism for transmitting a rotational force to the working tool.

2. Description of Related Art

Hammer drills provided with both a striking force transmitting mechanism and a rotational force transmitting mechanism have been conventionally provided with three operation modes: a rotation and strike mode for applying a striking force to the working tool while simultaneously driving the working tool to rotate, a rotation only mode for driving the working tool to rotate, and a strike only mode for applying a striking force to the working tool. This type of hammer drill requires an operation mode switching mechanism to switch the operation mode according to the desired operation.

One such operation mode switching mechanism has been proposed in U.S. Pat. No. 6,557,648 (corresponding to Japanese patent-application publication No. 2002-192481). This operation mode switching mechanism is provided with a gear and a clutch mechanism for each of the striking force transmitting mechanism and rotational force transmitting mechanism. In order to switch operation modes, the hammer drill uses the clutch mechanism to interrupt the transfer of a rotational force from a motor.

SUMMARY

However, the conventional operation mode switching mechanism described above requires a large number of parts and a complex construction. Consequently, the hammer drill has a larger body and is more expensive to construct. Further, the hammer drill is heavier and, thus, more difficult to operate.

In view of the foregoing, it is an object of the present invention to provide a hammer drill having a switching mechanism that is more compact, lighter, and cheaper to manufacture and that is easier to operate and has improved durability, by simplifying the structure and reducing the number of parts in the switching mechanism.

In order to attain the above and other objects, the present invention provides a hammer drill. The hammer drill includes a housing, a motor, a working tool, a striking force transmitting mechanism, a rotational force transmitting mechanism, and a switching mechanism. The motor is disposed in the housing and generates a rotational force. The striking force transmitting mechanism includes a cylinder, a piston, a motion converting mechanism, and a striking member. The cylinder is rotatably supported in the housing. The cylinder extends in an axial direction and has one end and another end. The working tool is engaged with the one end so as to be rotatable together with the cylinder. The working tool is movable in the axial direction. The piston is disposed adjacent to the another end in the cylinder and is movable in a reciprocating motion in the axial direction. The motion converting mechanism converts the rotational force of the motor into the reciprocating motion of the piston. The striking member is disposed between the working tool and the piston in the cylinder and is slidable in the axial direction. An air chamber is formed in the cylinder between the piston and the striking member. The cylinder is formed with at least one through-hole for providing fluid communication between the air chamber and an outside of the cylinder. The rotational force transmitting mechanism includes a gear that transmits the rotational force of the motor to the cylinder, thereby rotating the cylinder together with the working tool. The switching mechanism switches operation modes between a first operation mode and a second operation mode. In the first operation mode, the at least one through-hole is closed when the working tool is moved toward the another end and, when the at least one through-hole is closed, the reciprocating motion of the piston generates pressure changes in the air chamber, allowing the striking member to transmit a striking force to the working tool. In the second operation mode, the at least one through-hole is constantly open, prohibiting the striking member from transmitting a striking force to the working tool.

BRIEF DESCRIPTION OF THE DRAWINGS

The above and other objects, features and advantages of the invention will become more apparent from reading the following description of the embodiments taken in connection with the accompanying drawings in which.

DETAILED DESCRIPTION OF THE EMBODIMENTS

A hammer drill according to embodiments of the present invention will be described while referring to the accompanying drawings.

First Embodiment

Figure 1:
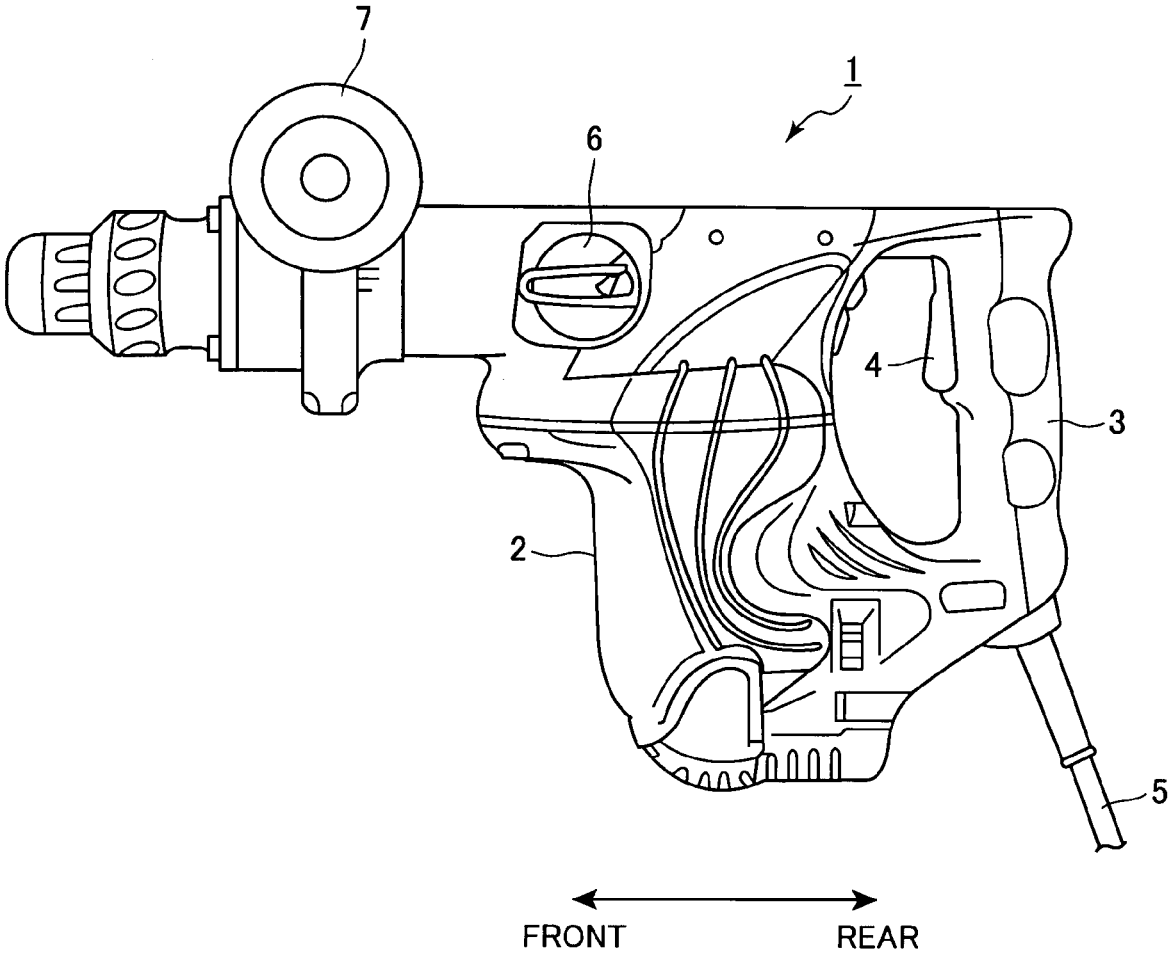
FIG. 1 is a side view of a hammer drill according to embodiments of the present invention.

FIG. 1 is a side view of a hammer drill 1 according to a first embodiment of the present invention. The hammer drill 1 shown in FIG. 1 can operate in four operation modes: a rotation and strike mode, a rotation only mode, a strike only mode, and a neutral mode. The hammer drill 1 includes a housing 2 for housing a striking force transmitting mechanism, a rotational force transmitting mechanism, and a switching mechanism described later.

The hammer drill 1 includes a handle 3 provided on the rear end of the housing 2 (the right end in FIG. 1); an ON/OFF switch 4 provided on the handle 3; an electric cord 5 connected to the handle 3 for supplying electricity to the hammer drill 1; a dial type switching member 6 rotatably disposed on a side of the housing 2 for switching operation modes; and a sub-handle 7 disposed near the front end of the housing 2 and protruding laterally (toward the viewer in FIG. 1).

A working tool 26 (see FIG. 2) described later is mounted on the front end of the hammer drill 1. The working tool 26 receives a striking force, a rotational force, or both to perform desired operations.

Next, the internal structure of the hammer drill 1 will be described in detail with reference to FIGS. 2 through 3B.

Figure 2:
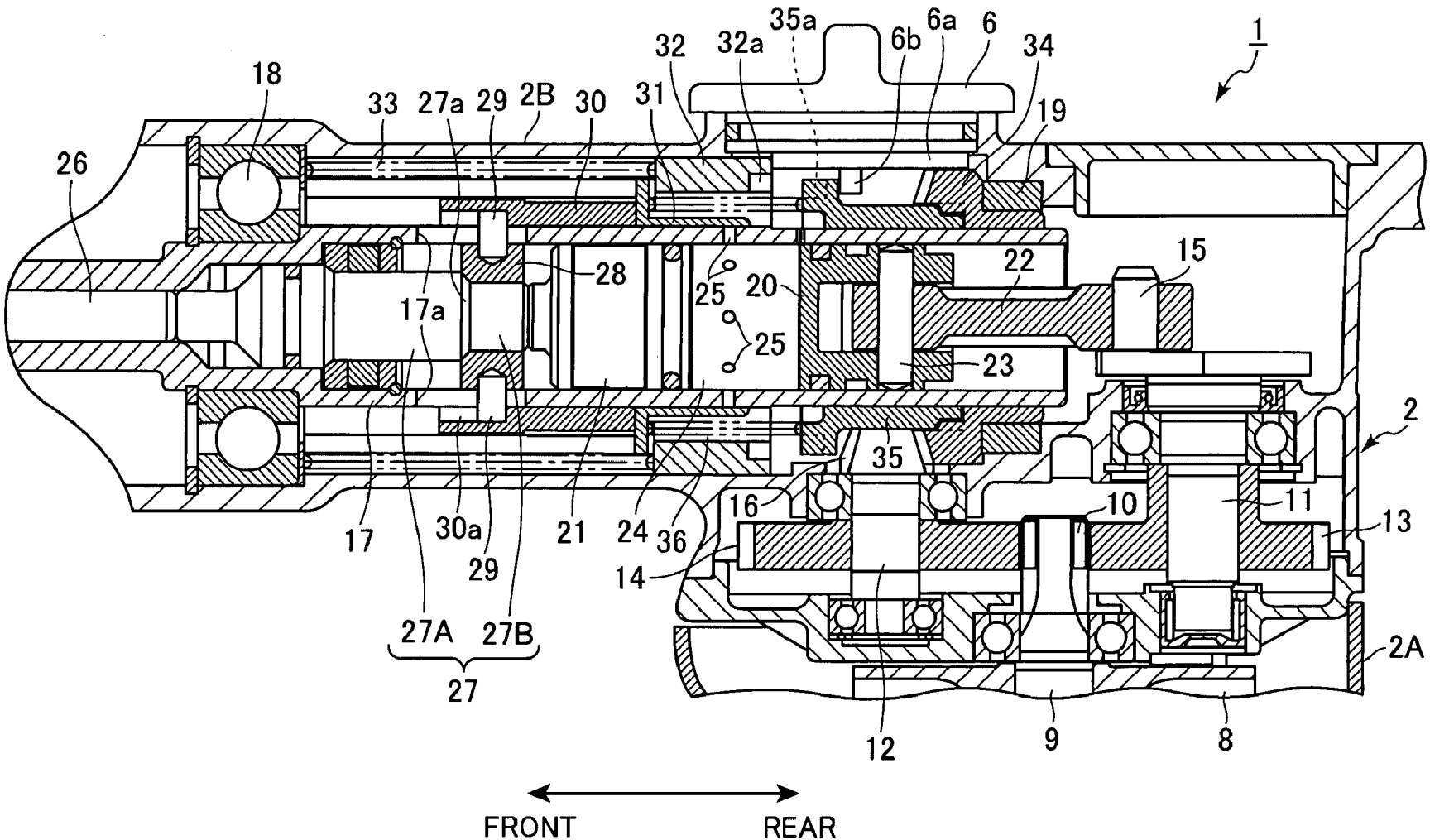
FIG. 2 is a vertical cross-sectional view of the hammer drill according to a first embodiment of the present invention in a rotation and strike mode.
Figure 3A:
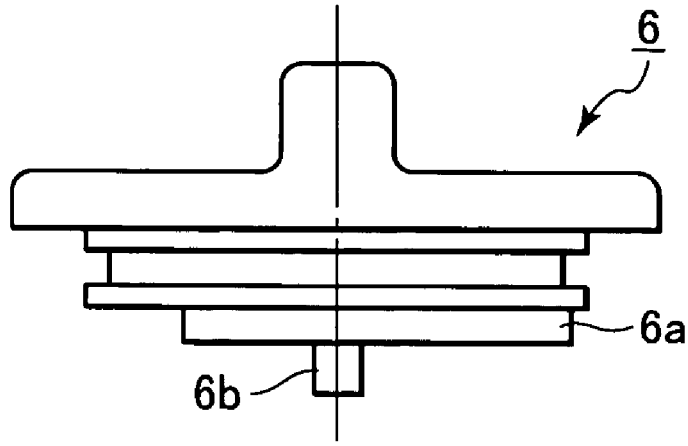
FIG. 3A is a side view of a switching member employed in the hammer drill according to the first embodiment.

FIG. 2 is a vertical cross-sectional view showing relevant parts of the hammer drill 1 according to the first embodiment of the present invention. FIG. 3A is a side view and FIG. 3B is a bottom view of the switching member 6 employed in the hammer drill 1. For description purposes, the switching member 6 disposed on the side of the housing 2 is shown by shifting 90 degrees in FIG. 2.

The housing 2 is configured of a motor housing 2A, and a cylinder case 2B affixed to the top of the motor housing 2A. The motor housing 2A accommodates a motor 8 serving as the drive source of the hammer drill 1. The motor 8 is disposed such that an output shaft (motor shaft) 9 protrudes upward from the motor 8. A pinion 10 is formed integrally with the top end of the output shaft 9.

A crankshaft 11 and an intermediate shaft 12 are vertically disposed and rotatably supported on the motor 8, one on either side of the output shaft 9. Gears 13 and 14 are mounted on the crankshaft 11 and intermediate shaft 12, respectively, at central positions with respect to the height of the same. The gears 13 and 14 are engaged with the pinion 10 formed on the top end of the output shaft 9. A crank pin 15 is formed integrally with the crankshaft 11 and is erected vertically from the top end of the crankshaft 11 at a position eccentric to the rotational center of the crankshaft 11. A bevel gear 16 having a small diameter is integrally formed on the top end of the intermediate shaft 12.

The cylinder case 2B extends horizontally in the front-to-rear direction. A cylinder 17 is disposed at a horizontal orientation inside the cylinder case 2B. The cylinder 17 is rotatably supported on both axial ends thereof by a ball bearing 18 and a metal bearing 19, respectively. A piston 20 and a striking member 21 are slidably fitted inside the cylinder 17. The piston 20 is connected to the crank pin 15 of the crankshaft 11 via a connecting rod 22. One end of the connecting rod 22 is coupled with the piston 20 via a piston pin 23.

An air chamber 24 is formed in the cylinder 17 between the piston 20 and striking member 21. A plurality of air holes (through-holes) 25 in fluid communication with the air chamber 24 is formed in the cylinder 17. The air holes 25 can selectively provide fluid communication between the air chamber 24 and an outside of the cylinder 17.

The cylinder 17 narrows toward the front end thereof. The working tool 26 is detachably mounted on the front end. The working tool 26 is engaged with the cylinder 11 so as to be able to slide in the axial direction of the cylinder 17 (front-to-rear direction) but to be unable to rotate circumferentially relative to the cylinder 17. In other words, the working tool 26 is rotatable together with the cylinder 17. An intermediate member 27 is fitted in the cylinder 17 between the working tool 26 and the striking member 21 and is capable of sliding horizontally. End faces of the intermediate member 27 contact respective end faces of the working tool 26 and striking member 21.

The intermediate member 27 has a central portion 27A and an end portion 27B. The end portion 27B is positioned closer to the striking member 21 than the central portion 27A is. The end portion 27B has a smaller diameter than the central portion 27A. An annular member 28 is fitted in the cylinder 17 so as to be capable of sliding horizontally (in the axial direction of the cylinder 17). The end portion 27B is fitted into a center hole of the annular member 28. A tapered step part 27*a* is formed between the end portion 27B and the central portion 27A and contacts an end face of the annular member 28. With this construction, the annular member 28 slides within the cylinder 17 toward the striking member 21 (rearward) together with the intermediate member 27, but does not slide with the intermediate member 27 toward the working tool 26 side (forward). The intermediate member 27 slides independently toward the working tool 26. A plurality of pins 29 is inserted into the outer periphery of the annular member 28 so as to protrude orthogonally to the peripheral surface. The pins 29 are inserted into elongated holes 17*a* formed in the cylinder 17 and extending axially. Hence, the annular member 28 retaining the pins 29 can slide in the axial direction (front-to-rear direction) within the range that the pins 29 can slide within the elongated holes 17*a*.

Two slidable sleeves 30 and 31 are fitted around the outer periphery of the cylinder 17 and are capable of sliding in the front-to-rear direction. The slidable sleeve 30 is positioned farther forward than the slidable sleeve 31. A plurality of engaging grooves 30*a* is formed on the inner periphery of the slidable sleeve 30 and extends axially for engaging the pins 29.

A rotation locking member 32 is disposed radially outwardly from the slidable sleeve 31. The outer peripheral surface of the rotation locking member 32 is fitted with the inner peripheral surface of the cylinder case 2B by spline fitting. Hence, the rotation locking member 32 is capable of sliding axially on the inner peripheral surface of the cylinder case 2B but is incapable of rotating circumferentially. A compressed spring 33 is mounted between the rotation locking member 32 and the ball bearing 18 for constantly urging the rotation locking member 32 rearward. The rear end face of the rotation locking member 32 contacts the peripheral surface (cam surface) of a cam 6*a* provided in the switching member 6.

Figure 3B:
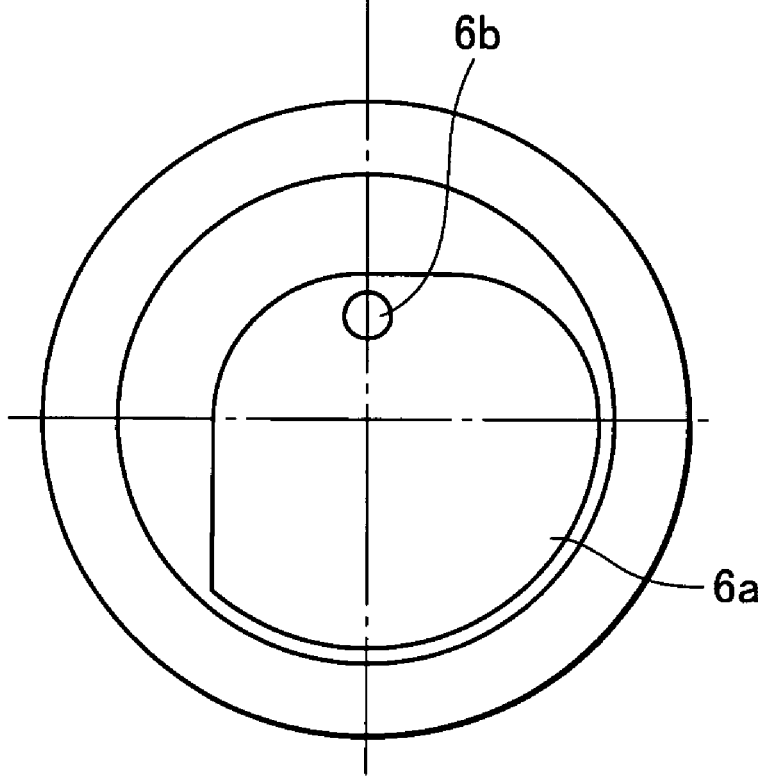
FIG. 3B is a bottom view of the switching member shown in FIG. 3A.

FIGS. 3A and 3B show a detailed structure of the switching member 6. The cam 6*a* mentioned above is integrally formed on the switching member 6 and has a cam surface with a profile such as that indicated in FIG. 3B. An eccentric pin 6*b* is integrally formed with the end face of the cam 6*a* protruding from the end face at a position offset from the rotational center of the switching member 6.

As shown in FIG. 2, a bevel gear 34 having a large diameter is rotatably supported on the peripheral surface of the cylinder 17 at the rear end thereof. The bevel gear 34 is engaged with the bevel gear 16 having a smaller diameter than that of the bevel gear 34. The bevel gear 34 is rotatably supported on the cylinder case 2B by both the rear end of the cylinder 17 and the metal bearing 19.

A coupling member 35 is fitted, by spline fitting, around the outer peripheral surface of the cylinder 17 between the rotation locking member 32 and the bevel gear 34 so as to be capable of sliding in the axial direction of the cylinder 17 (front-to-rear direction), but to be incapable of rotating circumferentially relative to the cylinder 17. In other words, the coupling member 35 rotates together with the cylinder 17. A compressed spring 36 is mounted between the coupling member 35 and slidable sleeve 31 for constantly urging the coupling member 35 rearward so that a step part formed on a front peripheral part of the coupling member 35 is in contact with the eccentric pin 6*b* of the switching member 6. A plurality of engaging pawls 35*a* is formed on the front end of the coupling member 35. The engaging pawls 35*a* selectively engage with a plurality of engaging pawls 32*a* formed on a rear end face of the rotation locking member 32. A plurality of engaging pawls 35*b* (see FIG. 5) is formed on an end face of the coupling member 35 for selectively engaging with a plurality of engaging pawls 34*a* (see FIG. 5) formed on the bevel gear 34. The coupling member 35 configures a dog clutch together with the rotation locking member 32 and bevel gear 34.

The gear 13, crankshaft 11, connecting rod 22, cylinder 17, piston 20, striking member 21, intermediate member 27, and the like described above constitute the striking force transmitting mechanism. The striking force transmitting mechanism converts rotation of the output shaft 9 in the motor 6 into reciprocating motion of the piston 20 to apply a striking force to the working tool 26.

Further, the gear 14, intermediate shaft 12, bevel gears 16 and 34, coupling member 35, cylinder 17, and the like described above constitute the rotational force transmitting mechanism. The rotational force transmitting mechanism transmits the rotation of the output shaft 9 to the working tool 26 for driving the working tool 26 to rotate.

In addition, the air holes 25, annular member 28, pins 29, slidable sleeves 30 and 31, spring 36, coupling member 35, rotation locking member 32, and the like described above constitute the switching mechanism.

Figure 4:
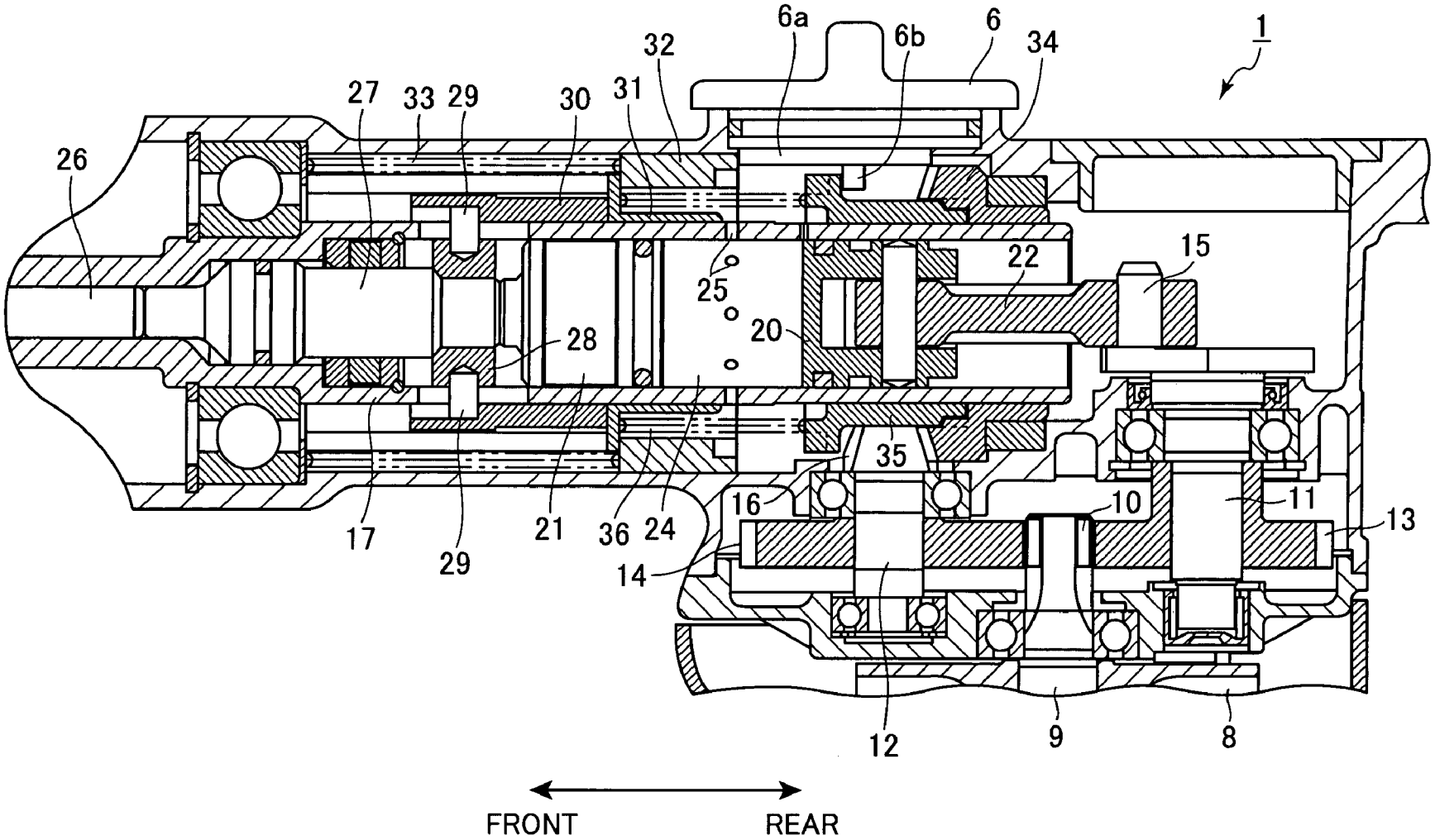
FIG. 4 is a vertical cross-sectional view of the hammer drill in a rotation only mode.
Figure 5:
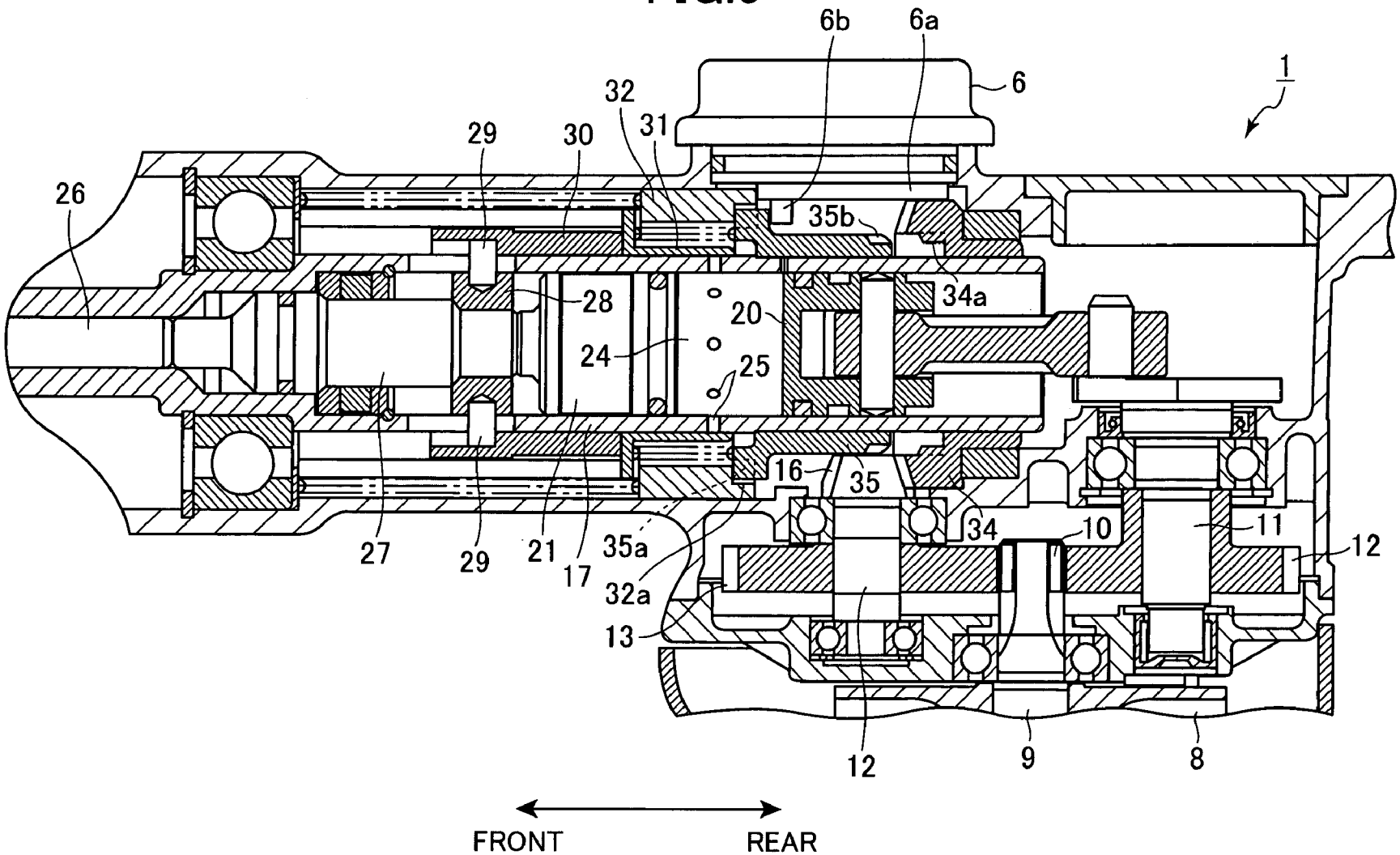
FIG. 5 is a vertical cross-sectional view of the hammer drill in a strike only mode.
Figure 6:
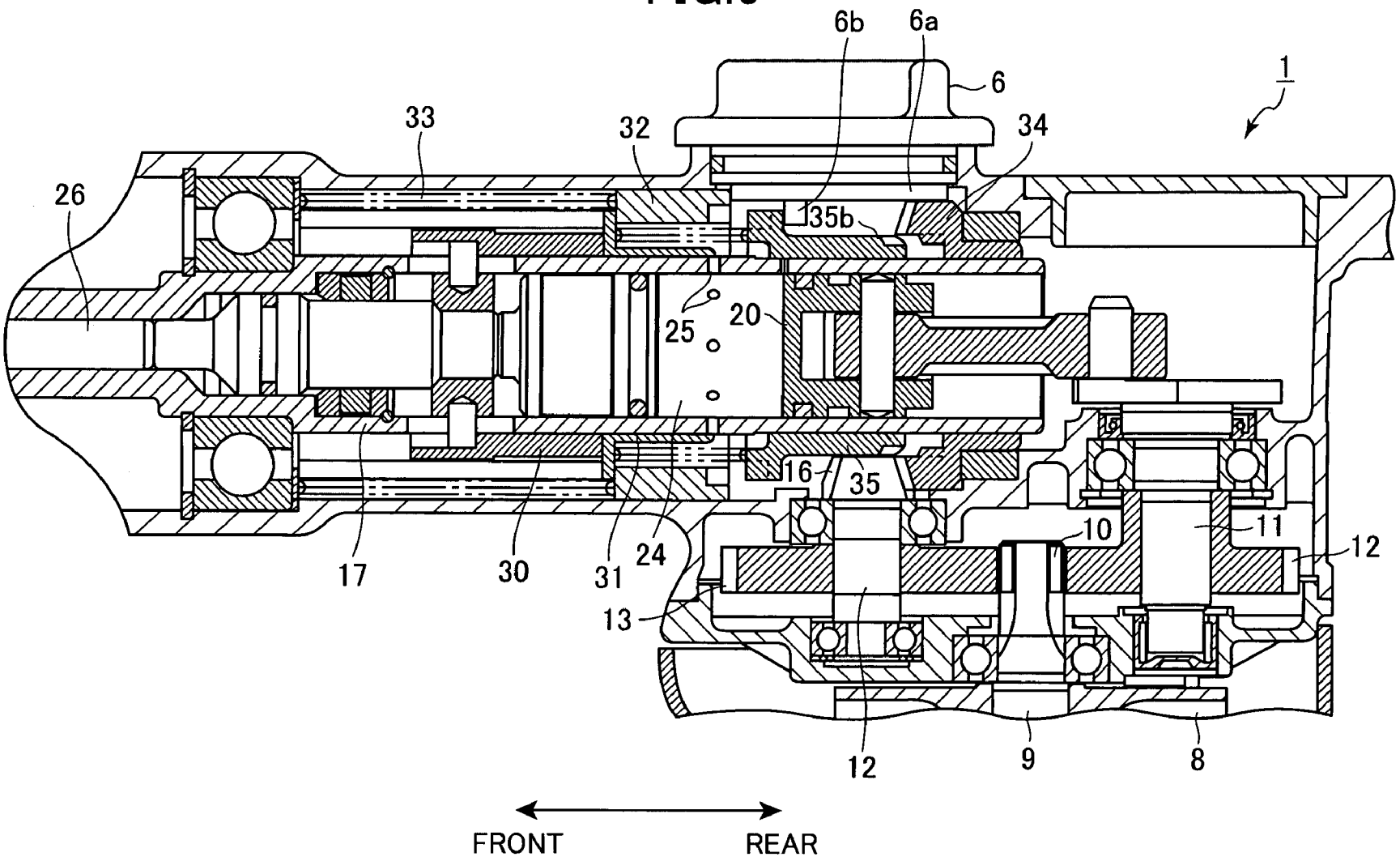
FIG. 6 is a vertical cross-sectional view of the hammer drill in a neutral mode.

Next, operations of the hammer drill having the construction described above will be described with reference to FIG. 2 and FIGS. 4 through 10 when the hammer drill is in 1) rotation and strike mode, 2) rotation only mode, 3) strike only mode, and 4) neutral mode (neutral state). FIG. 2 is a vertical cross-sectional view showing the relevant parts of the hammer drill during the rotation and strike mode. FIGS. 4, 5 and 6 are vertical cross-sectional views showing the relevant parts of the hammer drill during the rotation only mode, strike only mode, and neutral mode, respectively. FIGS. 7, 8, 9, and 10 are explanatory diagrams showing the orientation of the cam 6*a* in the switching mechanism 6 and the position of the eccentric pin 6*b* on the cam 6*a* during the rotation and strike mode, rotation only mode, strike only mode, and neutral mode, respectively.

1) Rotation and Strike Mode

Figure 7:
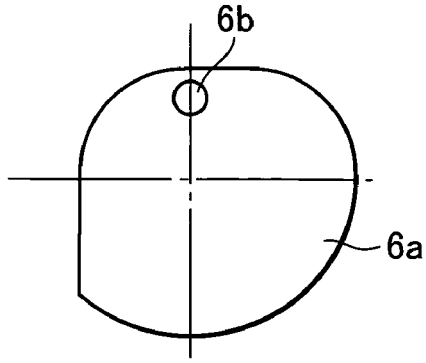
FIG. 7 is an explanatory diagram showing the orientation of a cam in the switching member and the position of an eccentric pin on the cam when the hammer drill is in the rotation and strike mode.

In the rotation and strike mode, the hammer drill 1 applies a striking force to the working tool 26 while driving the working tool 26 to rotate. When the switching member 6 is rotated to select the rotation and strike mode, the cam 6*a* and eccentric pin 6*b* of the switching member 6 are positioned as shown in FIG. 7. At this time, the coupling member 35 is engaged with the bevel gear 34, as shown in FIG. 2, and the engaging pawls 35*b* and engaging pawls 34*a* (see FIG. 5) are engaged (the clutch is ON). Further, as shown in FIG. 2, the rotation locking member 32, whose back surface contacts the end face (cam surface) of the cam 6*a*, is separated from the coupling member 35 (the clutch is OFF).

When the motor 8 is driven, the rotation of the output shaft 9 is decelerated via the pinion 10, gear 14, intermediate shaft 12, and bevel gears 16 and 34 and is transferred to the cylinder 17 via the coupling member 35 engaged with the bevel gear 34. Accordingly, the cylinder 17 and the working tool 26 mounted on the end of the cylinder 17 are driven to rotate so that the working tool 26 functions as a drill.

The rotation of the output shaft 9 in the motor 8 is also decelerated via the pinion 10 and gear 13 and transferred to the crankshaft 11 so that the crankshaft 11 is driven to rotate at a predetermined rate. The crank pin 15 and connecting rod 22 convert the rotation of the crankshaft 11 into a reciprocating linear motion of the piston 20 in the front-to-rear direction inside the cylinder 17. When the working tool 26 is pressed against a workpiece (not shown) at this time, the resulting reaction force is transferred via the intermediate member 27, annular member 28, pins 29, and slidable sleeve 30 to the slidable sleeve 31. Consequently, the slidable sleeve 31 opposes the urging force of the spring 36 and moves rearward over the cylinder 17 to seal the air holes 25 formed in the cylinder 17. As a result, the air chamber 24 formed in the cylinder 17 is substantially in a hermetically sealed state. The reciprocating motion of the piston 20 changes the internal pressure in the air chamber 24, causing the striking member 21 to move reciprocatingly in the front-to-rear direction inside the cylinder 17 and intermittently impact the intermediate member 27. Through this impact, a striking force is transferred from the intermediate-member 27 to the working tool 26.

2) Rotation Only Mode

Figure 8:
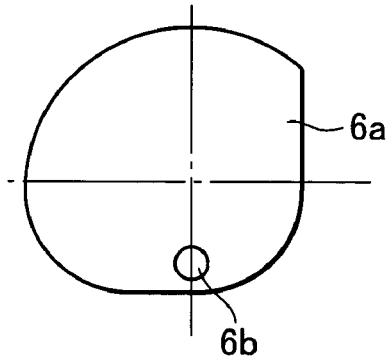
FIG. 8 is an explanatory diagram showing the orientation of the cam in the switching member and the position of the eccentric pin on the cam when the hammer drill is in the rotation only mode.

In the rotation only mode, the hammer drill 1 transfers only a rotational force to the working tool 26 to drive the working tool 26 to rotate. The rotation only mode is selected by rotating the switching member 6 180 degrees from the position shown in FIG. 7 so that the cam 6*a* and eccentric pin 6*b* of the switching member 6 are positioned as shown in FIG. 8.

At this time, the coupling member 35, whose step part on the outer peripheral surface is in contact with the eccentric pin 6*b* of the switching member 6, is coupled with the bevel gear 34, as in the rotation and strike mode, and both the engaging pawls 35*b* and engaging pawls 34*a* (see FIG. 5) are engaged (the clutch is ON). Further, the rotation locking member 32, whose rear end face is in contact with the cam surface of the cam 6*a*, is moved forward by the cam 6*a* against the urging force of the spring 33 so as to contact the slidable sleeve 31 and move the slidable sleeve 31 along with the slidable sleeve 30 forward along the outer periphery of the cylinder 17. Consequently, as the slidable sleeve 31 is moved, the seal over the air holes 25 is broken so that external air can pass through the air holes 25 into the air chamber 24 formed in the cylinder 17.

Since the coupling member 35 and bevel gear 34 are engaged in the rotation only mode (the clutch is ON), the rotation of the output shaft 9 is transferred to the cylinder 17 along the same path described for the rotation and strike mode. Accordingly, the cylinder 17 and working tool 26 mounted on the cylinder 17 are driven to rotate so that the working tool 26 functions only as a drill.

As in the rotation and strike mode, the rotation of the output shaft 9 in the motor 8 is converted to a reciprocating linear motion of the piston 20 inside the cylinder 17 in the rotation only mode. However, since the air holes 25 in the cylinder 17 are opened as described above, allowing external air to pass into the air chamber 24 in the cylinder 17, the reciprocating motion of the piston 20 does not produce a pressure change in the air chamber 24, thereby interrupting the transfer of a striking force to the working tool 26. Hence, the working tool 26 is only driven to rotate. At this time, the reaction force to the force at which the working tool 26 is pressed against the workpiece is transferred to the intermediate member 27, annular member 28, pins 29, and slidable sleeves 30 and 31. However, since the slidable sleeve 31 is in contact with the rotation locking member 32, movement of the slidable sleeve 31 is restricted in the axial direction, thereby maintaining the air holes 25 in an open state.

3) Strike Only Mode

Figure 9:
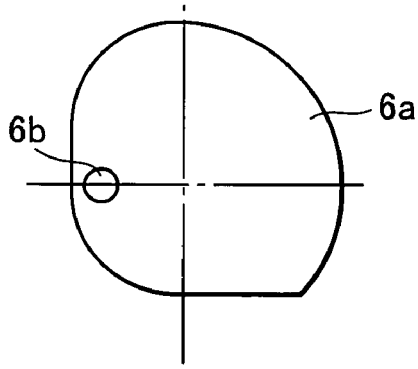
FIG. 9 is an explanatory diagram showing the orientation of the cam in the switching member and the position of the eccentric pin on the cam when the hammer drill is in the strike only mode.

In the strike only mode, only a striking force is transferred to the working tool 26. To select the strike only mode, the switching member 6 is rotated 90 degrees clockwise from the position shown in FIG. 8. In this state, the cam 6*a* and eccentric pin 6*b* of the switching member 6 are positioned as shown in FIG. 9.

At this time, as shown in FIG. 5, the eccentric pin 6*b*. of the switching member 6, which is in contact with the step part on the outer periphery of the coupling member 35, moves the coupling member 35 forward over the cylinder 17 so that the coupling member 35 separates from the bevel gear 34 and engages with the rotation locking member 32. The rotation locking member 32 locks the coupling member 35 to prevent the coupling member 35 from rotating. Hence, the engaging pawls 35*b* of the coupling member 35 is disengaged from the engaging pawls 34*a* of the bevel gear 34 (the clutch is OFF), and the engaging pawls 35*a* of the coupling member 35 is engaged with the engaging pawls 32*a* of the rotation locking member 32 (the clutch is ON). Since the rotation of the cylinder 17 and the working tool 26 is locked in the strike only mode, only a striking force is transferred to the working tool 26. Therefore, the hammer drill 1 can perform effectively as a hammer.

Further, the rotation locking member 32, whose rear end face contacts the cam surface of the cam 6*a*, is moved to the same position as in the rotation and strike mode. When a reaction force to the working tool 26 pressing against a workpiece is applied to the slidable sleeve 31, the slidable sleeve 31 moves to a position for sealing the air holes 25 formed in the cylinder 17.

Since the coupling member 35 and bevel gear 34 are disengaged in the rotation only mode, as described above, the bevel gear 34 rotates idly over the cylinder 17 so that this rotation is not transferred to the cylinder 17. Consequently, the cylinder 17 and the working tool 26 mounted on the cylinder 17 are in a non-rotation state, and the rotation of these components is locked by the engagement between the coupling member 35 and rotation locking member 32.

As in the rotation and strike mode, the slidable sleeve 31 in the rotation only mode also seals the air holes 25 formed in the cylinder 17, maintaining the air chamber 24 in a substantially hermetically sealed state. Hence, the reciprocating motion of the piston 20 produces pressure changes in the air chamber 24. As described above, these pressure changes transfer a striking force to the working tool 26 via the striking member 21 and the intermediate member 27 so that the working tool 26 functions as a hammer.

4) Neutral Mode

Figure 10:
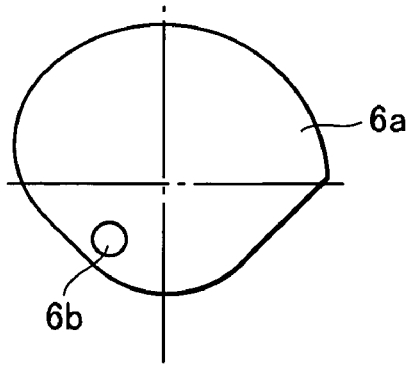
FIG. 10 is an explanatory diagram showing the orientation of the cam in the switching member and the position of the eccentric pin on the cam when the hammer drill is in the neutral mode.

In the neutral mode, neither the rotational force nor the striking force is transferred to the working tool 26. The neutral mode is selected by rotating the switching member 6 approximately 45 degrees clockwise from the position shown in FIG. 9. In this state, the cam 6*a* and eccentric pin 6*b* of the switching member 6 are positioned as shown in FIG. 10.

At this time, as shown in FIG. 6, the eccentric pin 6*b* of the switching member 6 contacting the step part on the outer periphery of the coupling member 35 moves the coupling member 35 forward over the cylinder 17. Consequently, the coupling member 35 separates from the bevel gear 34, so as not to be engaged with the bevel gear 34 or the rotation locking member 32.

Further, as in the rotation only mode, the cam 6*a* moves the rotation locking member 32 forward against the urging force of the spring 33. The rotation locking member 32 contacts the slidable sleeve 31 and moves the slidable sleeve 31 together with the slidable sleeve 30 forward along the outer periphery of the cylinder 17. Accordingly, the seal over the air holes 25 is broken, allowing external air to pass into the air chamber 24.

In the neutral mode described above, the coupling member 35 is disengaged (the clutch is OFF) from the bevel gear 34 and from the rotation locking member 32, and the air holes 25 formed in the cylinder 17 are open. Accordingly, neither a striking force nor a rotational force is transferred to the working tool 26 so that the working tool 26 is not operated. Since the working tool 26 can rotate idly in this state, the angular position of the working tool 26 can be easily adjusted.

Since the working tool 26 rotates idly in the neutral mode, the user can replace the working tool 26 with a different working tool or can easily adjust the angular position of the working tool 26 to a desired position. Further, since the rotation locking member 32 restricts the position of the slidable sleeve 31 in the neutral mode so that the air holes 25 is always open, a striking force is not transmitted to the working tool 26 so that the user can safely replace the working tool 26 or adjust the angular position of the working tool 26, even when the ON/OFF switch 4 is turned on during such an operation.

Since conventional hammer drills were constructed to transfer a striking force to the working tool 26 in the neutral mode when the ON/OFF switch 4 was turned on, problems such as the working tool 26 rotating accidentally could occur when the operating mode was set to the neutral mode and the user thought the operation mode was set to the strike only mode. However, the hammer drill according to the present embodiment can reliably prevent the occurrence of such problems in the neutral mode.

In the embodiment described above, the switching member 6 is operated to open and close the air holes 25 formed in the cylinder 17 with the slidable sleeve 31 in order to switch the strike mode ON and OFF and to engage the coupling member 35 with or disengage the coupling member 35 from the bevel gear 34 in order to switch the rotation mode ON and OFF. Accordingly, the slidable sleeve 31 and coupling member 35 constituting the switching mechanism can be both disposed around the cylinder 17, thereby simplifying the structure of the switching mechanism and reducing the number of parts in this structure. As a result, it is possible to construct a more compact hammer drill 1 that is lighter, less expensive to produce, easier to operate, and more durable.

Further, by simply rotating the working tool 26, the eccentric pin 6*b* of the switching member 6 slides the coupling member 35, while the cam 6*a* slides the rotation, locking member 32. With this construction, the operating mode can be switched among the rotation and strike mode, the strike only mode, the rotation only mode, and the neutral mode, thereby simplifying the operation of the switching mechanism.

It is necessary to replace the working tool 26 when switching from the strike only mode to the rotation only mode or vice versa. Therefore, as shown in FIGS. 7 through 10, in the present embodiment, the neutral mode is arranged between the strike only mode and the rotation only mode in the order for switching operation modes with the switching member 6. With this construction, the switching member 6 always passes through the neutral mode when switching from the strike only mode to the rotation only mode or vice versa, at which time replacement of the working tool 26 is required. Therefore, this construction facilitates replacement of the working tool 26 in the neutral mode prior to switching operation modes.

Table 1 below lists the state of engagement between the coupling member 35 and bevel gear 34 (ON or OFF) and the open/closed state of the air holes 25 formed in the cylinder 17 for each of the operating modes in the present embodiment.

TABLE 1

| Operating mode | Engagement state of the coupling member and bevel gear | Open/closed state of the air holes in the cylinder |
|---|---|---|
| Rotation and strike mode | ON | Closed |
| Rotation only mode | ON | Open |
| Strike only mode | OFF | Closed |
| Neutral mode | OFF | Open |

Table 2 below lists the ON/OFF state of rotational force transmission (state of engagement between the coupling member 35 and bevel gear 34, the ON/OFF state of striking force transfer (open/closed state of the air holes 25), and the ON/OFF state of the rotation locking function (state of engagement between the coupling member 35 and the rotation locking member 32) for each of the operating modes in the present embodiment.

TABLE 2

| Operating mode | Rotational force transmission | Striking force transmission | Rotation locking function |
|---|---|---|---|
| Rotation and strike mode | ON | ON | OFF |
| Strike only mode | OFF | ON | ON |
| Neutral mode | OFF | OFF | OFF |
| Rotation only mode | ON | OFF | OFF |

Second Embodiment

Next, a hammer drill according to a second embodiment of the present invention will be described with reference to FIGS. 11 and 12.

Figure 11:
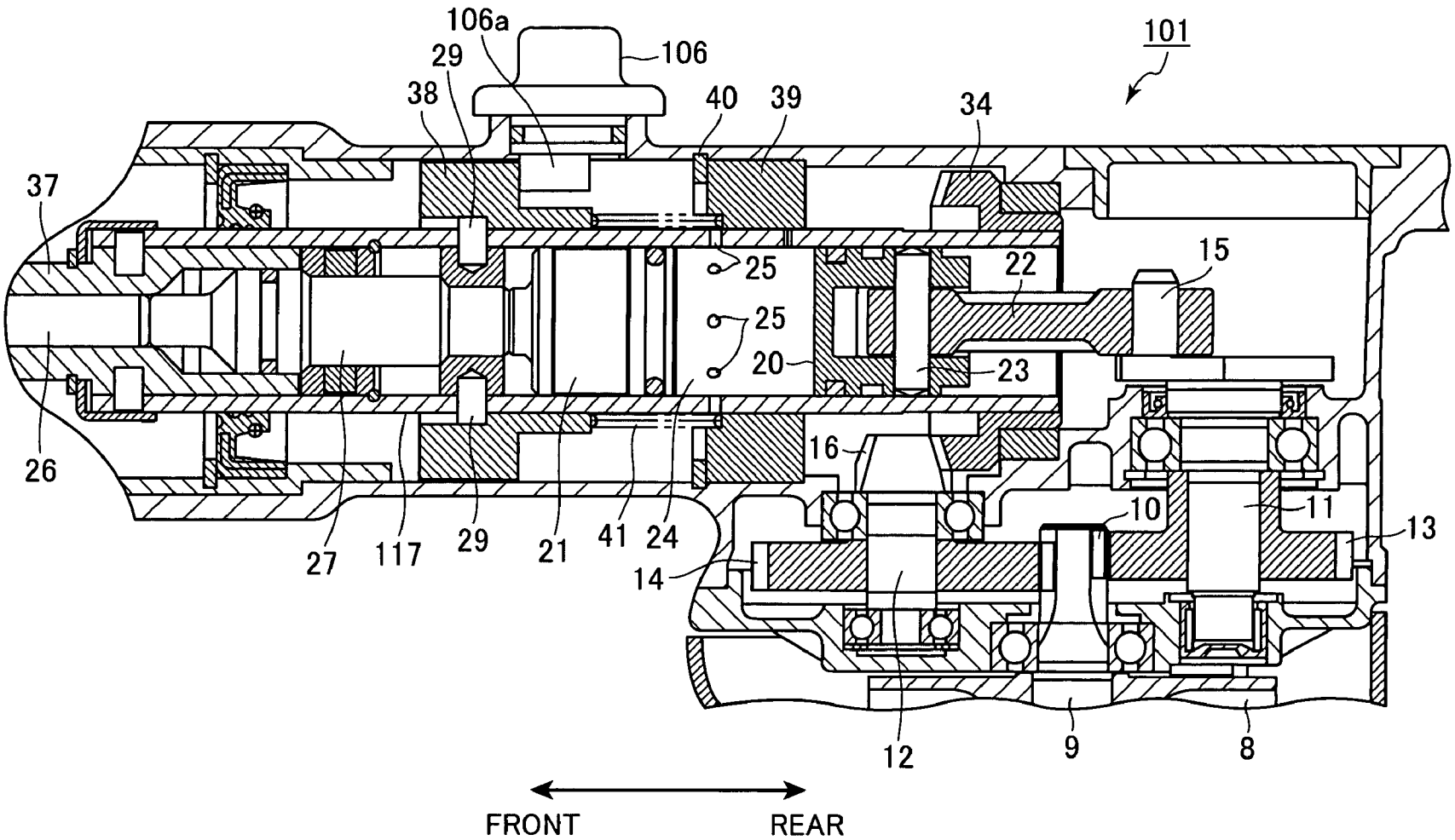
FIG. 11 is a vertical cross-sectional view of a hammer drill according to a second embodiment of the present invention in a rotation only mode.
Figure 12:
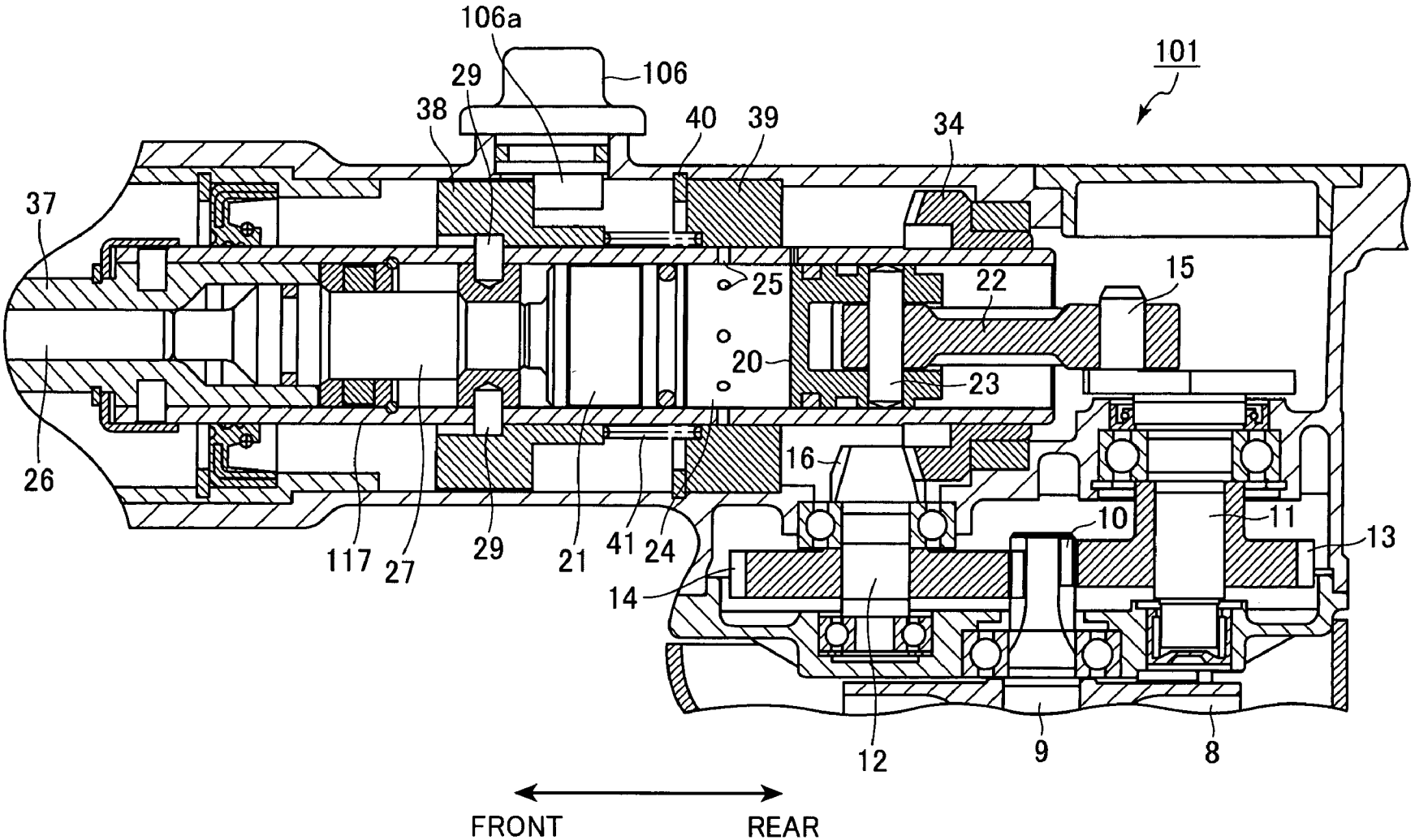
FIG. 12 is a vertical cross-sectional view of the hammer drill according to the second embodiment in a rotation and strike mode.

FIG. 11 is a vertical cross-sectional view of a hammer drill 101 according to the second embodiment in the rotation only mode, and FIG. 12 is a vertical cross-sectional view of the hammer drill 101 according to the second embodiment in the rotation and strike mode, wherein like parts and components are designated with the same reference numerals to avoid duplicating description.

In the hammer drill 101 according to the second embodiment, a cylinder 117 is held so as to be capable of moving in the front-to-rear direction. The bevel gear 34 is fitted, by spline fitting, around the outer periphery of the cylinder 117 on the rear end thereof, and the cylinder 117 can move forward and rearward relative to the bevel gear 34. The cylinder 117 rotates together with the bevel gear 34. In the present embodiment, the working tool 26 is mounted on the cylinder 117 via a tool sleeve 37. With this constructions the cylinder 117 and the working tool 26 constantly rotate together with the bevel gear 34.

In addition, a slidable sleeve 38 and a fixed sleeve 39 are fitted around the periphery of the cylinder 117. The slidable sleeve 38 is maintained so as to be slidable over the cylinder 117 in the front-to-rear direction. The fixed sleeve 39 is fixed in the axial direction of the cylinder 117 by a snap ring 40. A compressed spring 41 disposed between the slidable sleeve 38 and the fixed sleeve 39 constantly urges the slidable sleeve 38 forward.

In the hammer drill 101 having this construction, the working tool 26 is constantly driven to rotate, but the user can select between a rotation only mode and a rotation and strike mode.

Next, the operations of the hammer drill 101 according to the second embodiment will be described for the 1) rotation only mode and the 2) rotation and strike mode.

1) Rotation Only Mode

As shown in FIG. 11, the rotation only mode is selected by rotating a switching member 106 so that a cam 106*a* of the switching member 106 contacts the slidable sleeve 38 and moves the slidable sleeve 38 forward. In the second embodiment, the pins 29 engaged in the slidable sleeve 38 are inserted through and fixed in the cylinder 117 and do not move within elongated holes 17*a* as in the first embodiment. Hence, the cylinder 117 moves forward together with the slidable sleeve 38 at this time. When the cylinder 117 moves forward, the air holes 25 formed in the cylinder 117 move to a position forward of the fixed sleeve 39, thereby breaking the seal formed by the fixed sleeve 39 so that external air can pass through the air holes 25 into the air chamber 24.

When the motor 8 is driven, the rotation of the output shaft 9 is decelerated via the pinion 10, gear 14, intermediate shaft 12, and bevel gears 16 and 34 before being transferred to the cylinder 117. Consequently, the cylinder 117 and the working tool 26 mounted on the end of the cylinder 117 are driven to rotate so that the working tool 26 functions as a drill.

Further, the rotation of the output shaft 9 in the motor 8 is simultaneously transferred to the crankshaft 11 after being decelerated via the pinion 10 and gear 13. The crank pin 15 and connecting rod 22 convert the rotation of the crankshaft 11 into a reciprocating linear motion of the piston 20 within the cylinder 117. However, since the air holes 25 are in an open state in the cylinder 117 as described above, enabling external air to pass into the air chamber 24, the reciprocating motion of the piston 20 does not produce pressure changes in the air chamber 24. Accordingly, a striking force is not transferred to the working tool 26 and, hence, the working tool 26 is only rotated to function as a drill.

2) Rotation and Strike Mode

As shown in FIG. 12, the rotation and strike mode is selected by rotating the switching member 106 so that the slidable sleeve 38 contacting the cam 106*a* of the switching member 106 and the cylinder 117 are moved rearward. At this time, the fixed sleeve 39 seals the air holes 25 formed in the cylinder 117.

In the rotation and strike mode, the rotation of the output shaft 9 is transferred to the cylinder 117 along the same path as in the rotation only mode. Hence, the cylinder 117 and the working tool 26 mounted on the end of the cylinder 117 are driven to rotate so that the working tool 26 functions as a drill.

Further, since the air holes 25 formed in the cylinder 117 are sealed by the fixed sleeve 39 in the rotation and strike mode, the air chamber 24 in the intermediate member 27 is maintained substantially in a hermetically sealed state. Accordingly, the reciprocating motion of the piston 20 produces pressure changes in the air chamber 24, causing the striking member 21 to move back and forth in the cylinder 117 and intermittently impact the intermediate member 27. Hence, the intermediate member 27 transfers a striking force to the working tool 26 so that the working tool 26 also functions as a hammer.

In the second embodiment described above, the switching member 106 is operated to move the cylinder 117 via the slidable sleeve 38 in order to open and close the air holes 25 and switch the strike mode ON and OFF. Therefore, the slidable sleeve 38 and fixed sleeve 39 constituting the switching mechanism can both be mounted around the cylinder 117. As in the first embodiment described above, the second embodiment simplifies the structure of the switching mechanism and reduces the number of parts required in this mechanism. Accordingly, it is possible to construct a more compact hammer drill 101 that is lighter, less expensive to manufacture, easier to operate, and more durable.

While the invention has been described in detail with reference to the specific embodiment thereof, it would be apparent to those skilled in the art that various changes and modifications may be made therein without departing from the spirit of the invention.

What is claimed is:

1. A hammer drill comprising:

a housing;

a motor disposed in the housing and generating a rotational force;

a working tool;

a striking force transmitting mechanism comprising:

a cylinder rotatably supported in the housing, the cylinder extending in an axial direction and having a first end and a second end, the working tool being engaged with the first end so as to be rotatable together with the cylinder, the working tool being movable in the axial direction;

a piston disposed adjacent to the second end in the cylinder and movable in a reciprocating motion in the axial direction;

a motion converting mechanism that converts the rotational force of the motor into the reciprocating motion of the piston; and a striking member disposed between the working tool and the piston in the cylinder and slidable in the axial direction, an air chamber being formed in the cylinder between the piston and the striking member, the cylinder being formed with at least one through-hole for providing fluid communication between the air chamber and an outside of the cylinder;

a rotational force transmitting mechanism comprising a gear that transmits the rotational force of the motor to the cylinder, thereby rotating the cylinder together with the working tool; and a switching mechanism that switches operation modes between:

a first operation mode in which the at least one through-hole is closed when the working tool is moved toward the second end and, when the at least one through-hole is closed, the reciprocating motion of the piston generates pressure changes in the air chamber, allowing the striking member to transmit a striking force to the working tool; and a second operation mode in which the at least one through-hole is constantly open, prohibiting the striking member from transmitting a striking force to the working tool;

wherein the switching mechanism comprises a sleeve disposed around the cylinder, the sleeve being slidingly movable in the axial direction for closing the at least one through-hole when the working tool is moved toward the second end in the first operation mode; and wherein the switching mechanism switches the operation modes by restricting an amount of movement of the sleeve.

2. The hammer drill according to claim 1, wherein the switching mechanism switches the operation modes by restricting an amount of movement of the working tool toward the second end.

3. The hammer drill according to claim 1, wherein the cylinder is movable in the axial direction when the working tool is moved toward the second end; and wherein the switching mechanism switches the operation modes by restricting an amount of movement of the cylinder.

4. The hammer drill according to claim 1, wherein the switching mechanism comprises a cam rotatable in a plurality of rotational positions; and wherein the switching mechanism switches the operation modes according to rotational position of the cam.

5. The hammer drill according to claim 1, wherein the switching mechanism is capable of switching the operation mode to a third operation mode in which transmission of the rotational force to the cylinder is turned off.

6. The hammer drill according to claim 1, wherein the switching mechanism is capable of switching the operation modes among at least a rotation and strike mode, a rotation only mode, and a strike only mode.

7. The hammer drill according to claim 1, wherein the cylinder has an outer peripheral surface;

wherein the gear is rotatably supported around the outer peripheral surface of the cylinder;

wherein the rotational force transmitting mechanism further comprises a coupling member disposed around the outer peripheral surface of the cylinder, the coupling member being fitted with the outer peripheral surface of the cylinder by spline fitting; allowing the coupling member to be slidable in the axial direction for engaging with and disengaging from the gear; and wherein the switching mechanism comprises a switching member that can be operated at least among a first switch position in which the coupling member is engaged with the gear and a second switch position in which the coupling member is disengaged from the gear.

8. The hammer drill according to claim 7, wherein the switching member comprises an eccentric pin that moves the coupling member when the switching member is operated, allowing the coupling member to be engaged with the gear in the first switch position, and allowing the coupling member to be disengaged from the gear in the second switch position.

9. A hammer drill comprising:

a housing;

a motor disposed in the housing and generating a rotational force;

a working tool;

a striking force transmitting mechanism comprising:

a cylinder rotatably supported in the housing, the cylinder extending in an axial direction and having a first end and a second end, the working tool being engaged with the first end so as to be rotatable together with the cylinder, the working tool being movable in the axial direction;

a piston disposed adjacent to the second end in the cylinder and movable in a reciprocating motion in the axial direction;

a motion converting mechanism that converts the rotational force of the motor into the reciprocating motion of the piston; and a striking member disposed between the working tool and the piston in the cylinder and slidable in the axial direction, an air chamber being formed in the cylinder between the piston and the striking member, the cylinder being formed with at least one through-hole for providing fluid communication between the air chamber and an outside of the cylinder;

a rotational force transmitting mechanism comprising a gear that transmits the rotational force of the motor to the cylinder, thereby rotating the cylinder together with the working tool; and a switching mechanism that switches operation modes between:

a first operation mode in which the at least one through-hole is closed when the working tool is moved toward the second end and, when the at least one through-hole is closed, the reciprocating motion of the piston generates pressure changes in the air chamber, allowing the striking member to transmit a striking force to the working tool;

a second operation mode in which the at least one through-hole is constantly open, prohibiting the striking member from transmitting a striking force to the working tool; and wherein the switching mechanism switches the operation modes by restricting an amount of movement of the working tool toward the second end.

10. A hammer drill comprising:

a housing;

a motor disposed in the housing and generating a rotational force;

a working tool;

a striking force transmitting mechanism comprising:

a cylinder rotatably supported in the housing, the cylinder extending in an axial direction and having a first end and a second end, the working tool being engaged with the first end so as to be rotatable together with the cylinder, the working tool being movable in the axial direction;

a piston disposed adjacent to the second end in the cylinder and movable in a reciprocating motion in the axial direction;

a motion converting mechanism that converts the rotational force of the motor into the reciprocating motion of the piston; and a striking member disposed between the working tool and the piston in the cylinder and slidable in the axial direction, an air chamber being formed in the cylinder between the piston and the striking member, the cylinder being formed with at least one through-hole for providing fluid communication between the air chamber and an outside of the cylinder;

a rotational force transmitting mechanism comprising a gear that transmits the rotational force of the motor to the cylinder, thereby rotating the cylinder together with the working tool; and a switching mechanism that switches operation modes between:

a first operation mode in which the at least one through-hole is closed when the working tool is moved toward the second end and, when the at least one through-hole is closed, the reciprocating motion of the piston generates pressure changes in the air chamber, allowing the striking member to transmit a striking force to the working tool;

a second operation mode in which the at least one through-hole is constantly open, prohibiting the striking member from transmitting a striking force to the working tool;

wherein the cylinder is movable in the axial direction when the working tool is moved toward the second end; and wherein the switching mechanism switches the operation modes by restricting an amount of movement of the cylinder.

11. A hammer drill comprising:

a housing;

a motor disposed in the housing and generating a rotational force;

a working tool;

a striking force transmitting mechanism comprising:

a cylinder rotatably supported in the housing, the cylinder extending in an axial direction and having a first end and a second end, the working tool being engaged with the first end so as to be rotatable together with the cylinder, the working tool being movable in the axial direction;

a piston disposed adjacent to the second end in the cylinder and movable in a reciprocating motion in the axial direction;

a motion converting mechanism that converts the rotational force of the motor into the reciprocating motion of the piston; and a striking member disposed between the working tool and the piston in the cylinder and slidable in the axial direction, an air chamber being formed in the cylinder between the piston and the striking member, the cylinder being formed with at least one through-hole for providing fluid communication between the air chamber and an outside of the cylinder;

a rotational force transmitting mechanism comprising a gear that transmits the rotational force of the motor to the cylinder, thereby rotating the cylinder together with the working tool; and switching mechanism that switches operation modes between:

a first operation mode in which the at least one through-hole is closed when the working tool is moved toward the second end and, when the at least one through-hole is closed, the reciprocating motion of the piston generates pressure changes in the air chamber, allowing the striking member to transmit a striking force to the working tool;

a second operation mode in which the at least one through-hole is constantly open, prohibiting the striking member from transmitting a striking force to the working tool;

wherein the cylinder is movable in the axial direction when the working tool is moved toward the second end; and wherein the switching mechanism switches the operation modes by restricting an amount of movement of the cylinder.

12. A hammer drill comprising:

a housing;

a motor disposed in the housing and generating a rotational force;

a working tool;

a striking force transmitting mechanism comprising:

a cylinder rotatably supported in the housing, the cylinder extending in an axial direction and having a first end and a second end, the working tool being engaged with the first end so as to be rotatable together with the cylinder, the working tool being movable in the axial direction;

a piston disposed adjacent to the second end in the cylinder and movable in a reciprocating motion in the axial direction;

a motion converting mechanism that converts the rotational force of the motor into the reciprocating motion of the piston; and a striking member disposed between the working tool and the piston in the cylinder and slidable in the axial direction, an air chamber being formed in the cylinder between the piston and the striking member, the cylinder being formed with at least one through-hole for providing fluid communication between the air chamber and an outside of the cylinder;

a rotational force transmitting mechanism comprising a gear that transmits the rotational force of the motor to the cylinder, thereby rotating the cylinder together with the working tool; and a switching mechanism that switches operation modes between:

a first operation mode in which the at least one through-hole is closed when the working tool is moved toward the second end and, when the at least one through-hole is closed, the reciprocating motion of the piston generates pressure changes in the air chamber, allowing the striking member to transmit a striking force to the working tool; and a second operation mode in which the at least one through-hole is constantly open, prohibiting the striking member from transmitting a striking force to the working tool; and wherein the switching mechanism is capable of switching the operation mode to a third operation mode in which transmission of the rotational force to the cylinder is turned off.

13. The hammer drill according to claim 12, wherein the switching mechanism switches the operation modes by restricting an amount of movement of the working tool toward the second end.

14. The hammer drill according to claim 12, wherein the cylinder is movable in the axial direction when the working tool is moved toward the second end; and wherein the switching mechanism switches the operation modes by restricting an amount of movement of the cylinder.

15. The hammer drill according to claim 12, wherein the switching mechanism comprises a cam rotatable in a plurality of rotational positions; and wherein the switching mechanism switches the operation modes according to rotational position of the cam.

16. The hammer drill according to claim 12, wherein the switching mechanism is capable of switching the operation modes among at least a rotation and strike mode, a rotation only mode, and a strike only mode.

17. The hammer drill according to claim 12, wherein the cylinder has an outer peripheral surface;

wherein the gear is rotatably supported around the outer peripheral surface of the cylinder;

wherein the rotational force transmitting mechanism further comprises a coupling member disposed around the outer peripheral surface of the cylinder, the coupling member being fitted with the outer peripheral surface of the cylinder by spline fitting, allowing the coupling member to be slidable in the axial direction for engaging with and disengaging from the gear; and wherein the switching mechanism comprises a switching member that can be operated at least among a first switch position in which the coupling member is engaged with the gear and a second switch position in which the coupling member is disengaged from the gear.

18. The hammer drill according to claim 17, wherein the switching member comprises an eccentric pin that moves the coupling member when the switching member is operated, allowing the coupling member to be engaged with the gear in the first switch position, and allowing the coupling member to be disengaged from the gear in the second switch position.

19. A hammer drill comprising:

a housing;

a motor disposed in the housing and generating a rotational force;

a working tool;

a striking force transmitting mechanism comprising:

a cylinder rotatably supported in the housing, the cylinder extending in an axial direction and having a first end and a second end, the working tool being engaged with the first end so as to be rotatable together with the cylinder, the working tool being movable in the axial direction;

a piston disposed adjacent to the second end in the cylinder and movable in a reciprocating motion in the axial direction;

a motion converting mechanism that converts the rotational force of the motor into the reciprocating motion of the piston; and a striking member disposed between the working tool and the piston in the cylinder and slidable in the axial direction, an air chamber being formed in the cylinder between the piston and the striking member, the cylinder being formed with at least one through-hole for providing fluid communication between the air chamber and an outside of the cylinder;

a rotational force transmitting mechanism comprising a gear that transmits the rotational force of the motor to the cylinder, thereby rotating the cylinder together with the working tool; and a switching mechanism that switches operation modes between:

a first operation mode in which the at least one through-hole is closed when the working tool is moved toward the second end and, when the at least one through-hole is closed, the reciprocating motion of the piston generates pressure changes in the air chamber, allowing the striking member to transmit a striking force to the working tool; and a second operation mode in which the at least one through-hole is constantly open, prohibiting the striking member from transmitting a striking force to the working tool;

wherein the cylinder has an outer peripheral surface;

wherein the gear is rotatably supported around the outer peripheral surface of the cylinder;

wherein the rotational force transmitting mechanism further comprises a coupling member disposed around the outer peripheral surface of the cylinder, the coupling member being fitted with the outer peripheral surface of the cylinder by spline fitting, allowing the coupling member to be slidable in the axial direction for engaging with and disengaging from the gear; and wherein the switching mechanism comprises a switching member that can be operated at least among a first switch position in which the coupling member is engaged with the gear and a second switch position in which the coupling member is disengaged from the gear.

20. The hammer drill according to claim 19, wherein the switching member comprises an eccentric pin that moves the coupling member when the switching member is operated, allowing the coupling member to be engaged with the gear in the first switch position, and allowing the coupling member to be disengaged from the gear in the second switch position.

* * * * *